US006431368B1

(12) United States Patent
Carr

(10) Patent No.: US 6,431,368 B1
(45) Date of Patent: Aug. 13, 2002

(54) VIBRATORY SCREEN

(75) Inventor: Brian S. Carr, Independence, KY (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/610,633

(22) Filed: Jul. 5, 2000

(51) Int. Cl.[7] ..... B07B 1/46

(52) U.S. Cl. ..... 209/403; 209/401; 210/490; 210/497

(58) Field of Search ..... 209/401, 403, 209/397, 399; 210/499, 490, 492, 484

(56) References Cited

U.S. PATENT DOCUMENTS

| | | | | | |
|---|---|---|---|---|---|
| 659,416 | A | * | 10/1900 | Perry | |
| 1,459,845 | A | * | 6/1923 | Mitchell | |
| 1,718,385 | A | * | 6/1929 | Sherwood | |
| 1,947,307 | A | * | 2/1934 | Rafton | 209/401 |
| 2,061,850 | A | * | 11/1936 | Roberts | 210/76 |
| 2,082,513 | A | * | 6/1937 | Roberts | 210/76 |
| 2,455,383 | A | | 12/1948 | Pickard | 209/323 |
| 2,604,989 | A | * | 7/1952 | Warhol | 209/401 |
| 2,723,032 | A | * | 11/1955 | Gisler et al. | 209/401 |
| 3,214,314 | A | | 10/1965 | Rowbottam | 156/160 |
| 3,261,469 | A | | 7/1966 | Wehner | 209/325 |
| 3,905,788 | A | | 9/1975 | Alliger | 55/489 |
| 4,028,230 | A | | 6/1977 | Rosenblum | 209/403 |
| 4,120,785 | A | * | 10/1978 | Kanamori et al. | 209/401 |
| 4,247,007 | A | * | 1/1981 | Kai | 209/392 |
| 4,526,682 | A | | 7/1985 | Wallace | 209/337 |
| 4,575,421 | A | | 3/1986 | Derrick et al. | 209/397 |
| 4,696,751 | A | * | 9/1987 | Eifling | 210/780 |
| 4,728,422 | A | | 3/1988 | Bailey | 210/314 |
| 4,762,610 | A | | 8/1988 | Freissle | 210/499 |
| 4,861,462 | A | | 8/1989 | Lehmann et al. | 209/269 |
| 5,039,412 | A | | 8/1991 | Marsh | 210/488 |
| 5,047,148 | A | | 9/1991 | Arai | 210/499 |
| 5,076,924 | A | * | 12/1991 | Persson et al. | 210/474 |
| 5,221,008 | A | * | 6/1993 | Derrick, Jr. et al. | 209/369 |

(List continued on next page.)

FOREIGN PATENT DOCUMENTS

| | | |
|---|---|---|
| DE | 31 14573 C2 | 4/1987 |
| WO | WO 94/15723 | 7/1994 |
| WO | WO 94/23849 | 10/1994 |
| WO | WO 99 24144 A | 5/1999 |

OTHER PUBLICATIONS

U.S. Patent Application S.N. 09/401,425, filed Sep. 22, 1999, Brian S. Carr, Vibratory Screening System and Screen Therefor (Specification, Claims, Drawings).

*Primary Examiner*—Donald P. Walsh
*Assistant Examiner*—Joseph C Rodriguez
(74) *Attorney, Agent, or Firm*—Lyon & Lyon LLP

(57) ABSTRACT

A screen includes two or three layers of woven metal screen cloth. The coarsest of these layers includes threads which are woven into the cloth with surfaces which are fusible below a temperature at which the other layers of screen cloth are heat effected. These woven threads may include each of the threads in the coarse screen cloth with the coated threads being wire with fusible polypropylene or polyethylene coatings. The coarse screen cloth may include a woven metal screen with woven elements which are either coated with fusible material or are solidly of fusible material woven periodically therethrough in at least one direction. Screens are laminated with one or two fine mesh screens heated on the woven screen cloth with fusible surfaces to locate the fusible material in the finer cloths.

19 Claims, 5 Drawing Sheets

U.S. PATENT DOCUMENTS 5,330,057 A * 7/1994 Schiller et al. ..... 209/392
5,385,669 A 1/1995 Leone, Sr. ..... 210/488
5,417,793 A * 5/1995 Bakula ..... 156/308.2
5,417,858 A 5/1995 Derrick et al. ..... 210/488
5,417,859 A 5/1995 Bakula ..... 210/499
5,587,077 A 12/1996 Aaltonen et al. ..... 210/499
5,598,930 A * 2/1997 Leone et al. ..... 209/403
5,673,797 A * 10/1997 Bakula et al. ..... 209/392
5,720,881 A * 2/1998 Derrick ..... 210/388
5,783,077 A * 7/1998 Bakula ..... 210/388
5,814,218 A 9/1998 Cagle ..... 210/388
5,851,393 A 12/1998 Carr et al. ..... 210/489
5,868,929 A * 2/1999 Derrick et al. ..... 210/388
5,876,552 A * 3/1999 Bakula ..... 156/308.2
5,888,336 A * 3/1999 Bakula et al. ..... 156/308.2
5,944,993 A * 8/1999 Derrick et al. ..... 210/388
5,958,236 A * 9/1999 Bakula ..... 210/388
5,971,159 A * 10/1999 Leone et al. ..... 209/399
6,000,556 A * 12/1999 Bakula ..... 210/388
6,032,806 A * 3/2000 Leone et al. ..... 209/402
6,053,332 A * 4/2000 Bakula ..... 210/388
6,152,307 A * 11/2000 Adams et al. ..... 209/403

* cited by examiner

VIBRATORY SCREEN

BACKGROUND OF THE INVENTION

Vibratory screen systems have long been employed in both circular and rectangular form. The devices typically include a resiliently mounted housing having a screen extended across the housing. A vibration generating drive is coupled with the housing to vibrate the screen in an advantageous manner to increase screening efficiency. The screens are either self contained by including screen cloth tensioned and bonded to a frame or rely on mechanisms on the resiliently mounted housing for placement and tensioning. In the latter circumstance, the screen typically includes screen cloth to which may be mounted hooks or eyes for attachment of tensioning mechanisms associated with the housing.

Alternatively, screens can include a perforated plate with screen cloth bonded thereto. When a plate is used, the screen may be tensioned before bonding to the plate. The screen cloth may be bonded to the plate by a layer of epoxy or thermoplastic material. The bonding material is positioned on the plate and the screen tensioned thereover. The material is then treated, commonly by heating to either initiate curing of the epoxy or fusing of the thermoplastic material. Non-stick layers of PTFE sheet may be employed where the assembly is compressed during the curing or fusing step. Multiple layers of screen cloth are known to be used in such assemblies. The plates include interstices for the passage of the screened material therethrough.

Screens which employ hooks or eyes for tensioning by a separate mechanism having laminated layers have also been known. Bonding to frames by spot welding, epoxy or fusible material are known. Further, fusing multiple layers of screen cloth into the top of a frame structure made of fusible material having a peripheral frame and a pattern of open cells defined by cell walls has been previously known. The multiple screen cloths are bonded to the frame and the cell walls by fusing the frame structure and resolidifying it after impregnation through the screen cloth or cloths. Such a structure is disclosed in U.S. Pat. No. 5,851,393, the disclosure of which is incorporated herein by reference. Backup layers have been coated with epoxy and bonded to filter cloth such as disclosed in U.S. Pat. No. 5,814,218. Diffusion bonding is practiced between metal screens. The layers of screen cloth are pressed together and subjected to substantial heat for an extended time. No bonding material is used in the diffusion bonding process.

SUMMARY OF THE INVENTION

The present invention is directed to a laminated screen having two or more woven screen cloths. One of these woven screen cloths includes threads having surfaces which are fusible below a temperature at which the other woven screen cloth is heat affected. Heat effects to be avoided are changes in the physical and chemical properties of the screen cloth. These threads with surfaces fusible below a temperature at which the other woven screen cloth is heat affected are woven into the cloth. The screen cloths are of different mesh size with the courser mesh including the threads with fusible surface material. The fusible surface material is fused into the other screen cloth at the knuckle contacts of these threads with the finer screen cloth.

A number of embodiments are described which practice the foregoing inventive concept. Threads with fusible surfaces may be dispersed within the screen cloth to best advantage. Such threads may be arranged in only one direction of the screen cloth. Such. threads may be spaced apart with conventional threads therebetween. The threads with fusible surfaces may additionally be fusible fully therethrough. The screen cloth threads may be metal wire such as stainless steel.

Accordingly, it is an object of the present invention to provide an improved laminated screen. Other and further objects and advantages will appear hereinafter.

DETAILED DESCRIPTION OF THE PREFERRED EMBODIMENTS

Figure 1:
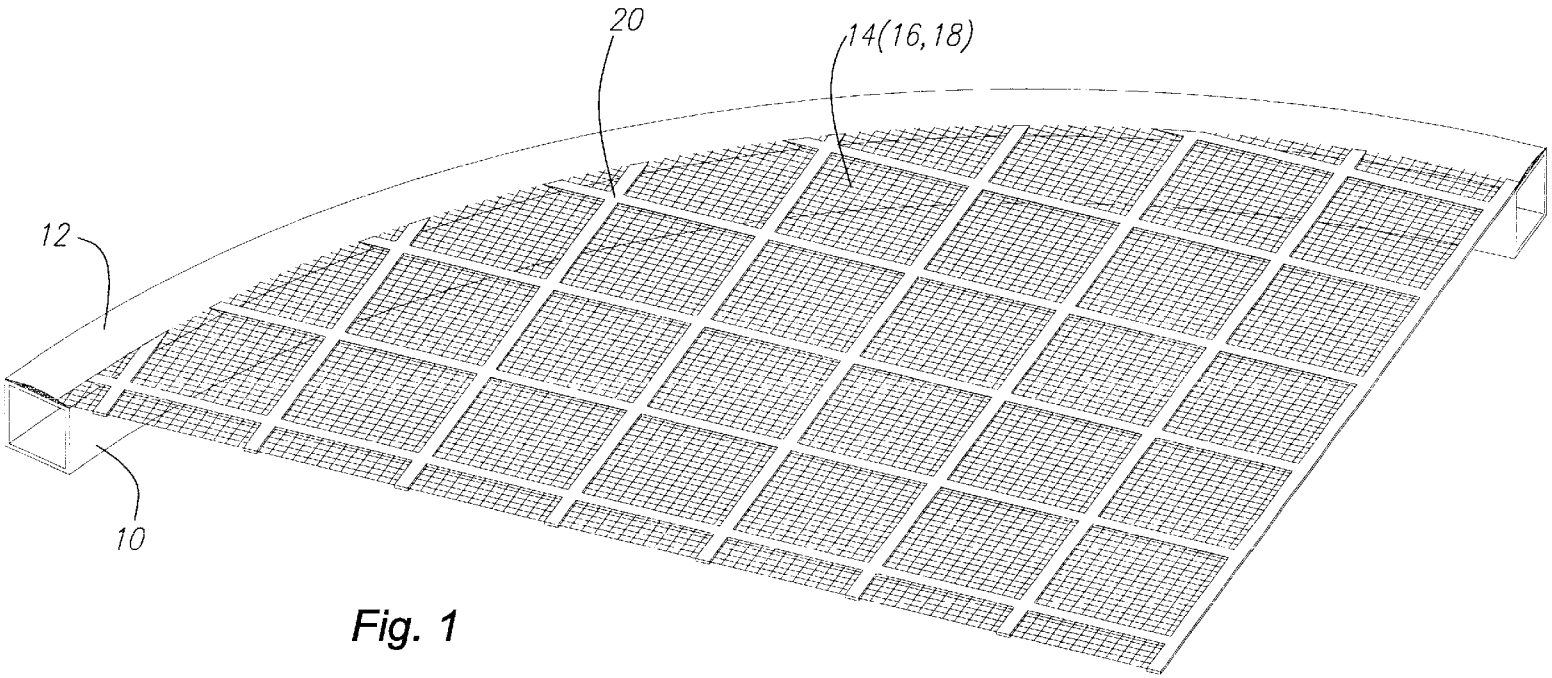
FIG. 1 is an assembled perspective view of a first laminated screen.
Figure 2:
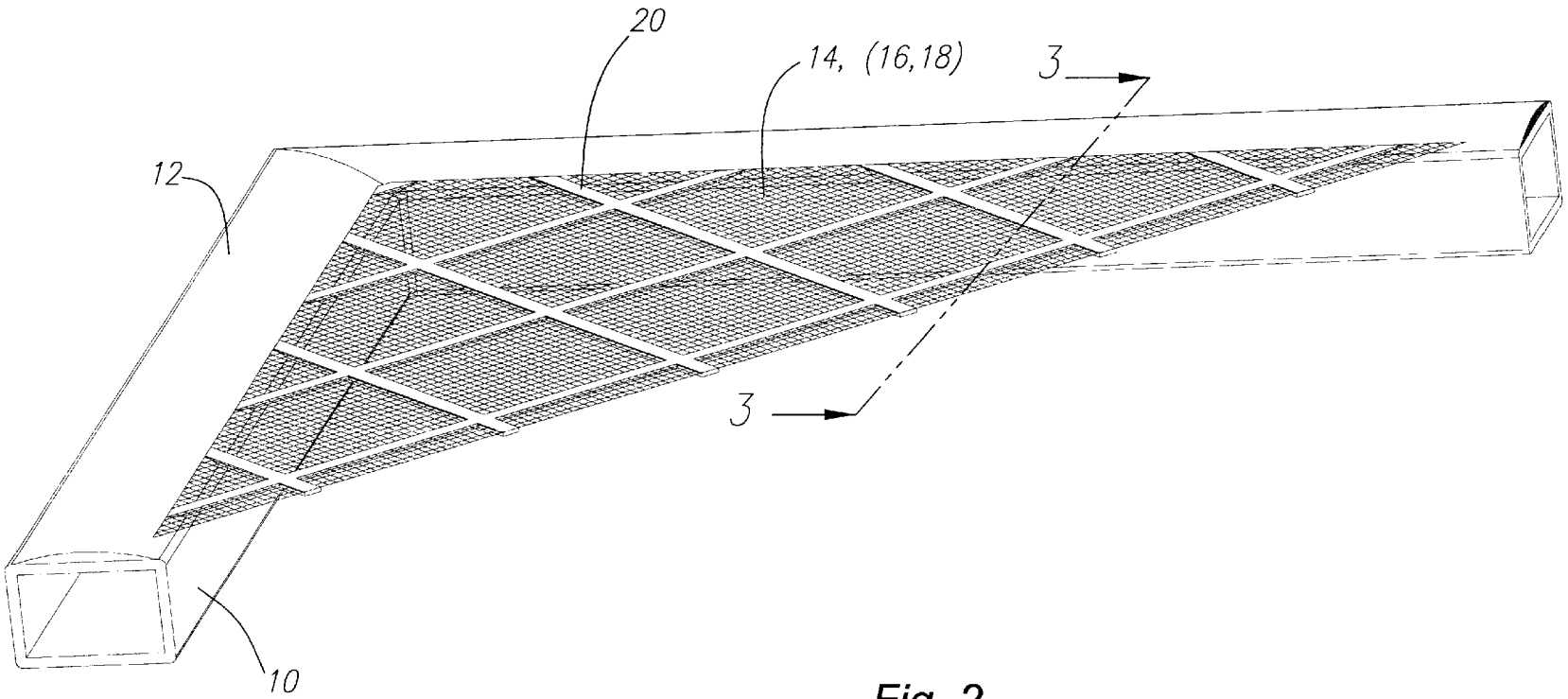
FIG. 2 is an exploded perspective view of the screen of FIG. 1.

Turning in detail to the drawings, FIGS. 1 and 2 illustrate a first screen. The screen is shown to include a first woven screen cloth 10. This screen cloth 10 may have a mesh size from 24 mesh (0.0075" wire diameter) to 635 mesh (0.0008" wire diameter). A coarser woven screen cloth 12 is illustrated in juxtaposition with the first woven screen cloth 10. This second screen cloth 12 forms a support layer. The mesh size for the screen cloth 12 may be, for example, as open as 1 mesh (0.135" wire diameter) and as tight as 40 mesh (0.012" wire diameter) but is more commonly from 4 mesh (0.0475" wire diameter) to 20 mesh (0.016" wire diameter). A third woven screen cloth 14 of equal to or finer mesh than the first woven screen cloth 10 may be positioned on the other side of the first screen cloth 10 from the coarse screen cloth 12. For most applications, the coarse screen cloth 12 is substantially coarser than the first woven screen cloth 10 which is, in turn, typically coarser than the third woven screen cloth 14, when a third such layer is employed. In one example, the screen layers have mesh sizes of 20 wires/inch, 84 wires/inch and 100 wires/inch, respectively. Such screen cloth is conventionally of stainless steel but can be of heat resistant polymer.

The coarse woven screen cloth 12 is shown in the embodiment of FIGS. 1 and 2 to be made of stainless steel wires 16 which are all coated with a fusible surface 18 before being woven into cloth. The fusible surface may be polypropylene or polyethylene. These materials are fusible below a temperature at which the screen cloth 10 and the screen cloth 14 are heat affected. For example, polypropylene is fused sufficiently to exhibit the required flow properties at between 400° F. and 450° F. As the wire of the screens is typically stainless, polypropylene and polyethylene are fusible well below a temperature at which the screen cloth is heat affected. Because the coarse screen cloth 12 is woven, it provides knuckles which become the high points of contact between the coarse screen cloth 12 and the juxtaposed screen cloth 10. As the screen cloth 12 is much coarser than the screen cloth 10, the knuckles of the coarse screen cloth 12 are spaced substantially compared with the interstices through the screen cloth 10. This is even truer for the screen cloth 14 with even finer mesh. The coating forming the fusible surface may increase the stainless steel wire diameter of 0.018" to a total of 0.030" with the fusible layer before the threads are fused, for example.

The layers of screen cloth, a coarse mesh 12 with a fine mesh 10 or two fine meshes 10 and 14, are compressed together and heated. The compression may be accomplished by two platens. Depending on the system, either the platen on the side of the fine mesh screen or both platens may be heated to a sufficient degree that the fusible surface on the knuckles contacting the finer mesh screen cloth will melt and flow into the interstices in the screen cloth 10 or screen cloths 10 and 14. This fusible material is then allowed to cool and solidify to create a laminated structure with attachment points 20. Where appropriate, thin layers of PTFE may be employed to avoid sticking with the platens.

Figure 3:
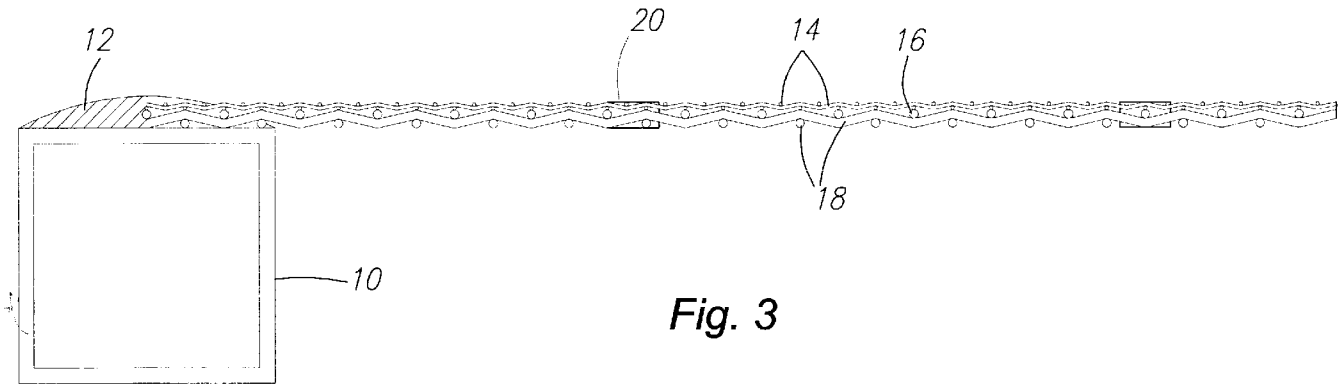
FIG. 3 is an assembled perspective view of a second laminated screen.
Figure 4:
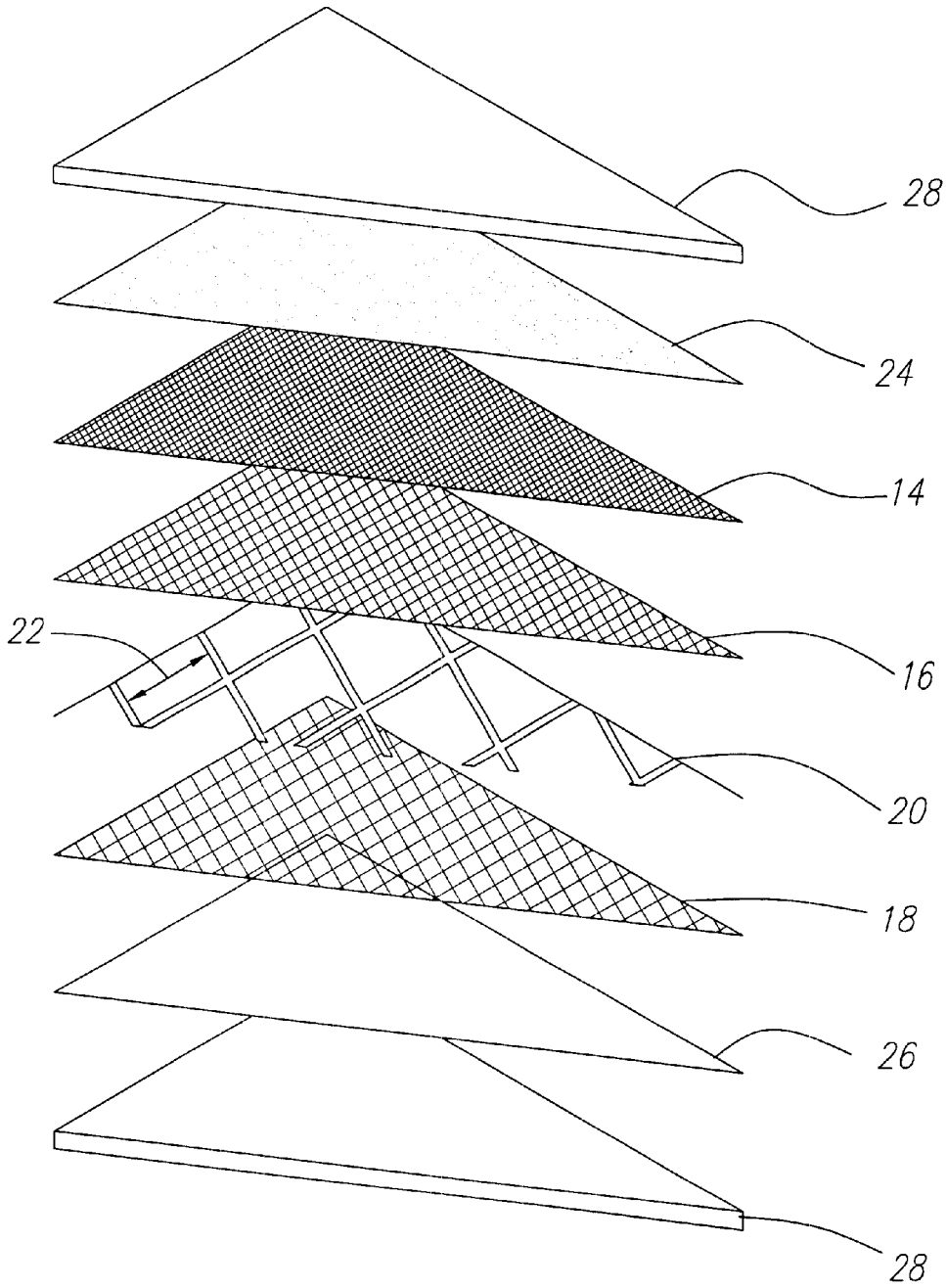
FIG. 4 is an exploded perspective view of the screen of FIG. 3.
Figure 5:
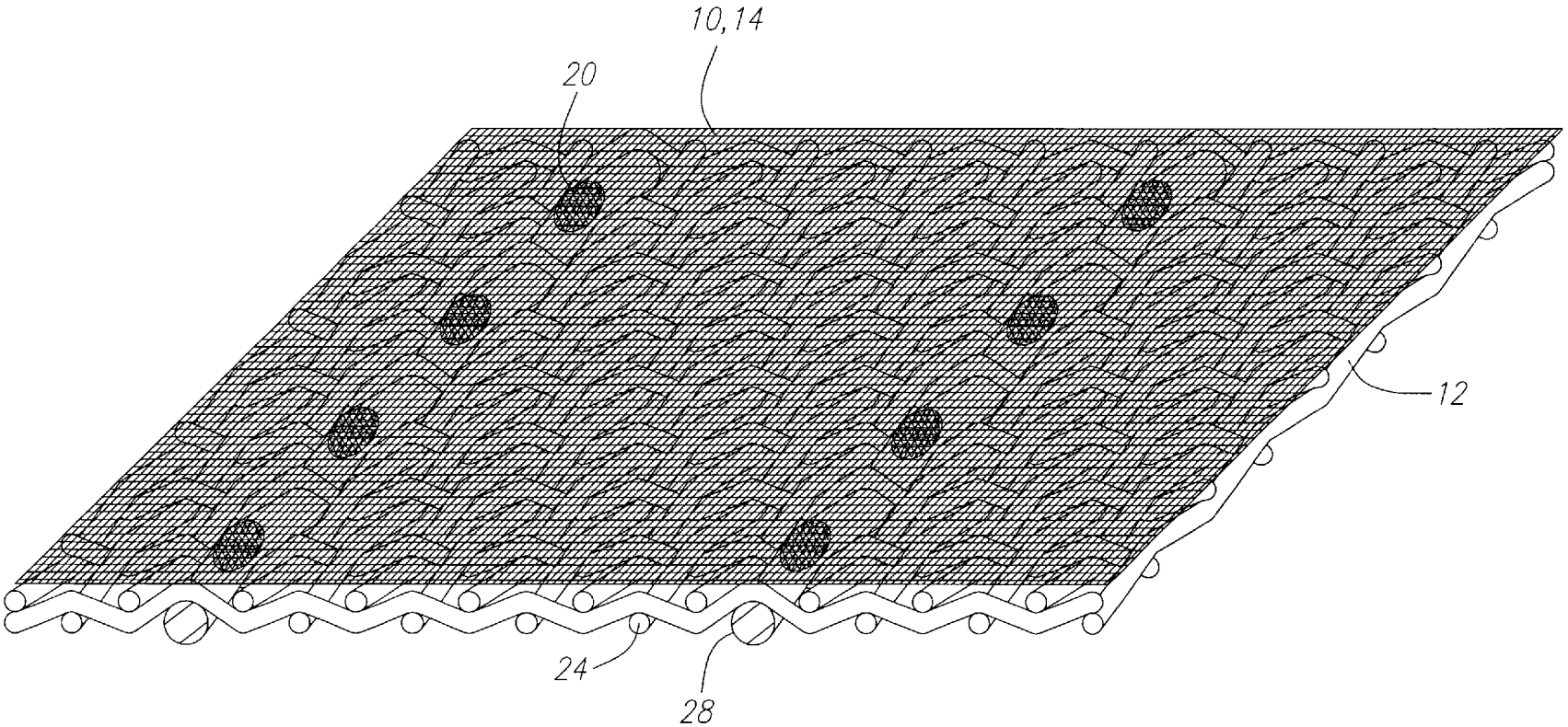
FIG. 5 is an assembled perspective view of a third laminated screen.
Figure 6:
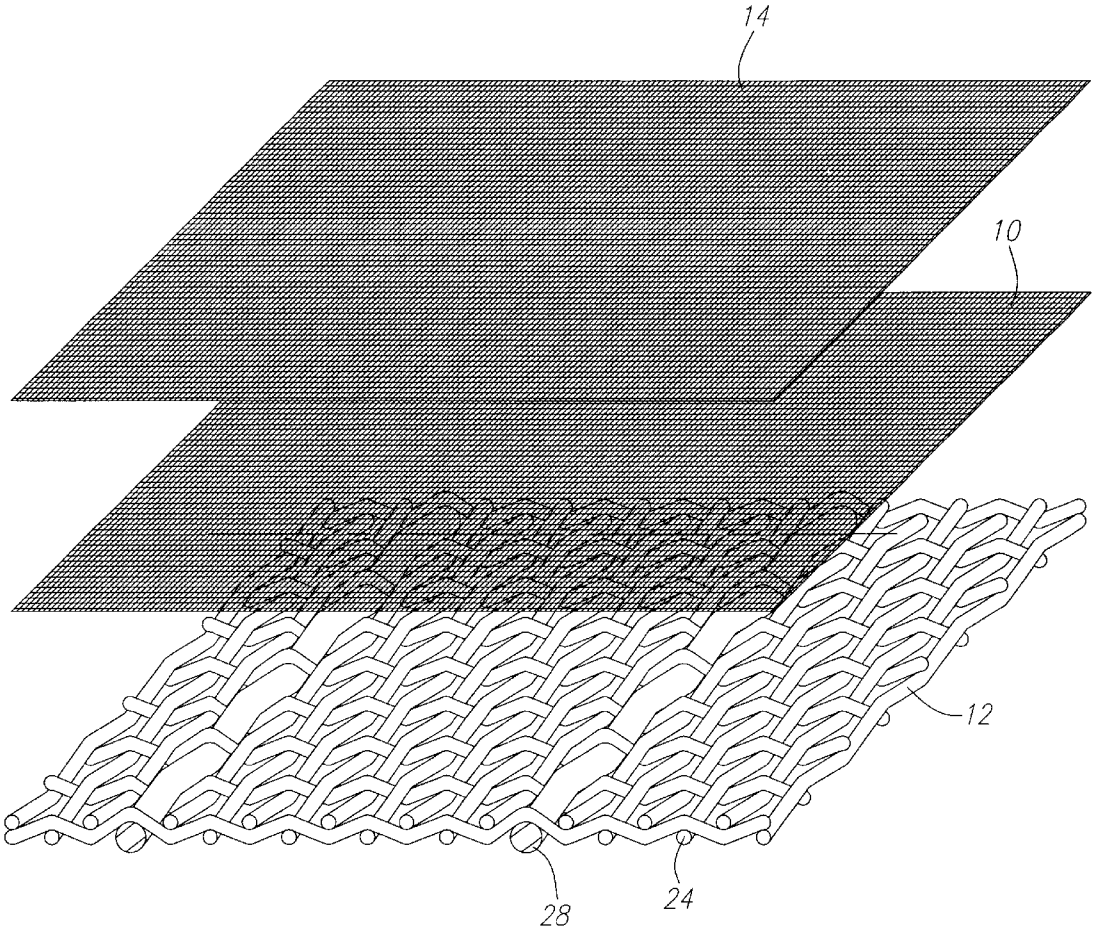
FIG. 6 is an exploded perspective view of the screen of FIG. 5.

The second and third embodiments of FIGS. 3 through 6 illustrate different arrangements for the fusible material. In the embodiment of FIGS. 3 and 4, periodic threads 22 extending in only one direction and spaced apart with uncoated threads 24 therebetween are shown to have fusible surfaces 26. These threads 22 are also woven into the fabric with the coating 26 thereon. An example of the coating in this instance on metal wire having a diameter of 0.018" will increase the thread diameter to 0.030". In the embodiment of FIGS. 5 and 6, the fusible coated threads 28 are additionally fusible fully therethrough. Again they are shown to be spaced apart and extend in only one direction. The threads therebetween are not fusible below the temperature at which the screen 10 is heat affected. An example in this instance for screen cloth having metal wire with a diameter of 0.018" would be to use a fusible thread diameter of 0.039".

Accordingly, new laminated screen structures are disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A screen comprising a first woven screen cloth;

a second woven screen cloth including threads woven therein having surfaces which are fusible below a temperature at which the first woven screen cloth is heat affected, the first woven screen cloth being of substantially finer mesh than the second woven screen cloth and in juxtaposition therewith, the threads with the fusible surfaces being fused into the first woven screen cloth at least at the knuckle contacts of the threads with the fusible surfaces with the first woven screen cloth, the threads with fusible surfaces extending in only one direction of the second woven screen cloth.

2. A screen comprising a first woven screen cloth;

a second woven screen cloth including threads woven therein having surfaces which are fusible below a temperature at which the first woven screen cloth is heat affected, the first woven screen cloth being of substantially finer mesh than the second woven screen cloth and in juxtaposition therewith, the threads with the fusible surfaces being fused into the first woven screen cloth at least at the knuckle contacts of the threads with the fusible surfaces with the first woven screen cloth, the second woven screen cloth further including threads without surfaces fusible below the temperature at which the first woven screen cloth is heat affected, the threads with the fusible surfaces being spaced apart with a plurality of the threads without surfaces fusible below the temperature at which the first woven screen cloth is heat affected being therebetween.

3. The screen of claim 2 further comprising a third woven screen cloth in juxtaposition with the first woven screen cloth and having a substantially finer mesh than the second woven screen cloth, the threads with the fusible surfaces being fused into the third woven screen cloth at the knuckle contacts of the threads with the fusible surfaces with the first woven screen cloth.

4. The screen of claim 2, the threads with the fusible surfaces having metal wire centers with a coating which is fusible below the temperature at which the first woven screen cloth is heat affected.

5. A screen comprising a first woven screen cloth;

a second woven screen cloth made by weaving at least some threads therein having surfaces which are fusible below a temperature at which the first woven screen cloth is heat affected, the first woven screen cloth being of substantially finer mesh than the second woven screen cloth and in juxtaposition therewith, the threads with the fusible surfaces being fused into the first woven screen cloth at least at the knuckle contacts of the threads with the fusible surfaces with the first woven screen cloth, the threads with the fusible surfaces being fusible fully therethrough below a temperature at which the first woven screen cloth is heat affected, the second woven screen cloth further including threads without surfaces fusible below the temperature at which the first woven screen cloth is heat affected, the threads with the fusible surfaces being spaced apart with a plurality of the threads without surfaces fusible below the temperature at which the first woven screen cloth is heat affected being therebetween.

6. A screen comprising a first woven metal screen cloth;

a second woven metal screen cloth including threads woven therein having surfaces which are fusible below a temperature at which the first woven metal screen cloth is heat affected and extending in only one direction of the second woven metal screen cloth and metal threads without surfaces fusible below the temperature at which the first woven metal screen cloth is heat affected, the first woven metal screen cloth being of substantially finer mesh than the second woven metal screen cloth and in juxtaposition therewith, the threads with the fusible surfaces being spaced apart with a plurality of the metal threads without surfaces fusible below the temperature at which the first woven metal screen cloth is heat affected being therebetween, the threads with the fusible surfaces being fused into the first woven metal screen cloth at least at the knuckle contacts of the second woven metal screen cloth with the first woven metal screen cloth.

7. The screen of claim 6 further comprising a third woven metal screen cloth in juxtaposition with the first woven metal screen cloth and having a substantially finer mesh than the second woven metal screen cloth,the threads with the fusible surfaces being fused into the third woven metal screen cloth at the knuckle contacts of the second woven metal screen cloth with the first woven metal screen cloth.

8. The screen of claim 6, the threads with the fusible surfaces being fusible fully therethrough below a temperature at which the first woven screen cloth is heat affected.

9. A screen comprising a first woven screen cloth;

a second woven screen cloth made by weaving at least some threads therein having fusible surfaces, the first woven screen-cloth being of substantially finer mesh than the second woven screen cloth and in juxtaposition therewith, the threads with the fusible surfaces being fused into the first woven screen cloth at least at the knuckle contacts of the threads with the fusible surfaces with the first woven screen cloth, the second woven screen cloth further including threads without fusible surfaces, the threads with the fusible surfaces being spaced apart with the plurality of the threads without fusible surfaces being therebetween.

10. The screen of claim 9 further comprising a third woven metal screen cloth in juxtaposition with the first woven screen cloth and having a substantially finer mesh than the second woven screen cloth, the threads. with the fusible surfaces being fused into the third woven screen cloth at the knuckle contacts of the threads with the fusible surfaces with the first woven screen cloth.

11. The screen cloth of claim 9, the threads with the fusible surfaces having metal wire centers with a fusible coating.

12. The screen of claim 9, the threads with the fusible surfaces being fusible fully therethrough below a temperature at which the first woven screen cloth is heat affected.

13. A screen comprising a first woven metal screen cloth;

a second woven screen cloth including threads woven therein having surfaces which are fusible and metal threads without fusible surfaces, the first woven metal screen cloth being of substantially finer mesh than the second woven screen cloth and in juxtaposition therewith, the threads with the fusible surfaces being spaced apart with a plurality of the metal threads without fusible surfaces being therebetween, the threads with the fusible surfaces being fused into the first woven metal screen cloth at least at the knuckle contacts of the second woven screen cloth with the first woven metal screen cloth.

14. The screen of claim 13 further comprising a third woven metal screen cloth in juxtaposition with the first woven metal screen cloth and having a substantially finer mesh than the second woven screen cloth, the threads with the fusible surfaces being fused into the third woven metal screen cloth at the knuckle contacts of the second woven screen cloth with the first woven metal screen cloth.

15. The screen of claim 13, the threads with the fusible surfaces being fusible fully therethrough below a temperature at which the first woven screen cloth is heat affected.

16. A screen comprising a first woven screen cloth;

a second woven screen cloth having metal threads in two directions and periodic threads fusible therethrough among the metal threads at least in one direction therein, the threads fusible therethrough being fusible below a temperature at which the first woven screen cloth is heat affected, the first woven screen cloth being of substantially finer mesh than the second woven screen cloth and in juxtaposition therewith, the threads fusible therethrough being fused into the first woven screen cloth at least at the knuckle contacts of the threads fusible therethrough with the first woven screen cloth.

17. The screen of claim 16, the first woven screen cloth being of metal threads.

18. The screen of claim 16 further comprising a third woven screen cloth in juxtaposition with the first woven screen cloth and having a substantially finer mesh than the second woven screen cloth, the threads fusible therethrough being fused into the third woven screen cloth at the knuckle contacts of the threads fusible there through with the first woven screen cloth.

19. The screen of claim 18, the first and third woven screen cloths being of metal threads.

* * * * *